United States Patent [19]

Bissell et al.

[11] Patent Number: 4,498,844

[45] Date of Patent: Feb. 12, 1985

[54] LIQUID RING PUMP WITH CONICAL OR CYLINDRICAL PORT MEMBER

[75] Inventors: Douglas E. Bissell, Fairfield; Charles M. Jozepaitis, Bridgeport, both of Conn.

[73] Assignee: The Nash Engineering Company, Norwalk, Conn.

[21] Appl. No.: 521,449

[22] Filed: Aug. 8, 1983

[51] Int. Cl.[3] ..... F04C 19/00

[52] U.S. Cl. ..... 417/68

[58] Field of Search ..... 417/68, 69

[56] References Cited

U.S. PATENT DOCUMENTS

| | | | |
|---|---|---|---|
| 1,180,613 | 4/1916 | Siemen . | |
| 2,344,396 | 3/1944 | Dardelet . | |
| 2,453,373 | 11/1948 | Kollsman . | |
| 3,154,240 | 10/1964 | Jennings . | |
| 3,217,975 | 11/1965 | Jennings . | |
| 3,348,766 | 10/1967 | Mugele . | |
| 3,366,314 | 1/1968 | Schroder . | |
| 3,707,337 | 12/1972 | Segebrecht | 417/68 |
| 3,721,508 | 3/1973 | Mugele | 417/68 |
| 3,884,596 | 5/1975 | Hoffmeister | 417/68 |
| 4,392,783 | 7/1983 | Jozepaitis | 417/68 |

FOREIGN PATENT DOCUMENTS

| | | |
|---|---|---|
| 51080 | 12/1935 | Denmark . |
| 2704863 | 8/1978 | Fed. Rep. of Germany . |
| 55-5427 | 1/1980 | Japan . |
| 206273 | 11/1939 | Switzerland . |
| 11378 | of 1906 | United Kingdom . |
| 2064002A | 6/1981 | United Kingdom . |

*Primary Examiner*—Edward K. Look

*Attorney, Agent, or Firm*—Robert R. Jackson; David W. Plant

[57] ABSTRACT

A liquid ring pump with a conical or cylindrical port member has a vent-recirculation port in the port member in addition to the conventional intake and discharge ports. The vent-recirculation port communicates with the compression zone of the pump and is connected to a reservoir of pumping liquid maintained in the discharge portion of the pump head. When the pump is operating at relatively low compression ratios, the vent-recirculation port acts as a vent to prevent overcompression of the gas in the pump. At relatively high compression ratios, the vent-recirculation port recirculates pumping liquid from the reservoir, thereby increasing the maximum attainable compression ratio.

5 Claims, 18 Drawing Figures

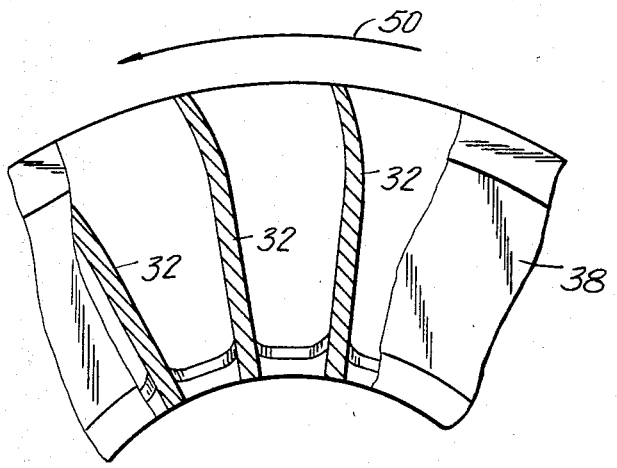
FIG. 15
FIG. 17
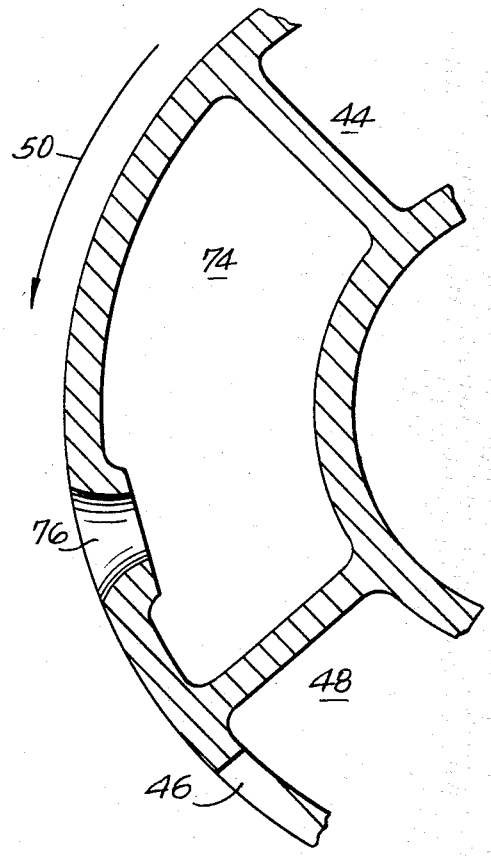
FIG. 16
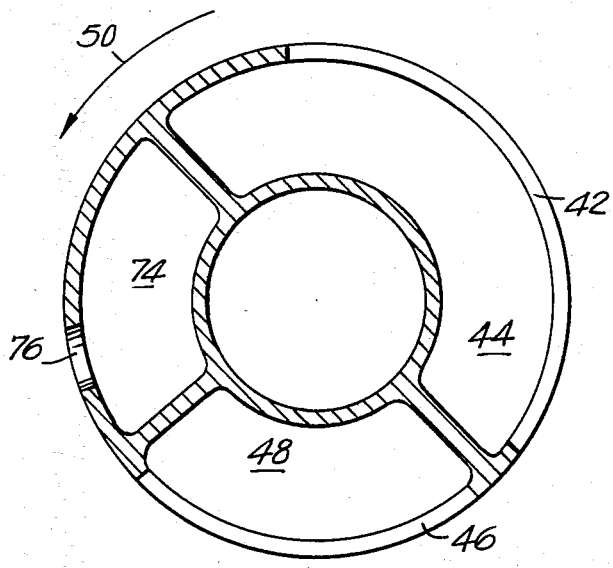

LIQUID RING PUMP WITH CONICAL OR CYLINDRICAL PORT MEMBER

BACKGROUND OF THE INVENTION

This invention relates to liquid ring pumps, and more particularly to liquid ring pumps having conical or cylindrical port members.

A liquid ring pump having conical port members is shown in Jennings U.S. Pat. No. 3,154,240. The principal components of this pump are (1) a cylindrical housing: (2) a rotatable shaft mounted eccentrically in the housing; (3) a bladed rotor fixedly mounted on the shaft; (4) two frusto-conical port members coaxial with the shaft, each port member extending into an annular recess in a respective one of the opposite ends of the rotor and having (a) an intake port for admitting to the rotor the gas, vapor, or gas-vapor mixture to be pumped (hereinafter referred to generically as gas) and (b) a discharge port for conveying compressed gas from the rotor; and (5) a head member at each end of the pump for conveying gas between the associated port member and appropriate pump inlets and outlets. Although the port members shown in the above-mentioned Jennings patent are frusto-conical, those skilled in the art frequently refer to them as conical, and that terminology is accordingly employed herein. Those skilled in the art will also appreciate that the port members in the Jennings device need not be tapered in the manner of a cone, but could alternatively be cylindrical, in which case the pump would be referred to as cylindrically ported.

Returning to the Jennings device, a quantity of pumping liquid (e.g., water) is maintained in the housing. When the shaft and rotor are rotated, the rotor blades engage the pumping liquid and form it into an annular ring concentric with the housing. The liquid ring cooperates with the rotor blades to form a plurality of gas pumping chambers, each chamber being bounded by (1) two adjacent rotor blades, (2) the adjacent portion of the rotor hub or the conical port member, and (3) the adjacent portion of the inner surface of the liquid ring. Because the rotor is eccentric to the housing, these pumping chambers vary in size in a cyclic fashion as the rotor rotates. On the side of the pump in which the rotor blades are diverging from the housing, the pumping chambers are expanding. This is the gas intake zone of the pump, and the intake ports are therefore located so as to communicate with the pumping chambers in this zone. On the side of the pump in which the rotor blades are converging toward the housing, the pumping chambers are contracting. This is the gas compression zone of the pump, and the discharge ports are therefore located so as to communicate with the pumping chambers in this zone.

Liquid ring pumps are typically designed to provide a particular compression ratio or a relatively narrow range of compression ratios for extended periods of time. When a liquid ring pump is subjected to off-normal operating conditions, the power required to operate the pump may increase substantially. For example, when a liquid ring pump is being started and the compression ratio is lower than normal, very high pressures may occur in the compression zone of the pump prior to the discharge port. This overcompression of the gas being pumped increases the power necessary to drive the pump until the normal compression ratio is achieved. In order to meet these occasional increased power requirements, the pump must be equipped with a motor larger than would otherwise be necessary. This is uneconomical, and it is clearly desirable to minimize the amount by which the power requirements of the pump increase under off-normal operating conditions.

Another consideration in the design of liquid ring pumps is that the higher the compression ratio the pump is designed to achieve, the more sensitive the pump becomes to off-normal operating conditions. Typically, if a liquid ring pump is designed to achieve a very high compression ratio, it is subject to very severe overcompression problems at lower than normal compression ratios. Similarly, unless a liquid ring pump is designed to achieve a high compression ratio (in which case it typically operates less efficiently at lower compression ratios), it generally cannot achieve such high compression ratios at all.

Still another characteristic of liquid ring pumps, especially those designed for operation at relatively low speeds and low compression ratios, is that such pumps may exhibit instability manifested by excessive vibration and loss of pumping ability when subjected to compression ratios higher than the design compression ratio. This condition may be ameliorated by increasing the flow of pumping liquid to the pump. But this approach usually increases pump operating cost and and may only shift the point at which the pump becomes unstable.

In view of the foregoing, it is an object of this invention to improve liquid ring pumps of the type described above.

It is another object of this invention to provide liquid ring pumps of the type described above which operate efficiently over relatively broad compression ratio ranges.

It is yet another object of this invention to provide liquid ring pumps of the type described above which are capable of achieving relatively high compression ratios without excessive inefficiency at lower compression ratios.

It is still another object of this invention to increase the stability of operation of liquid ring pumps of the type described above without increasing the rate at which pumping liquid must be supplied to the pump.

It is yet another object of this invention to increase the efficiency of liquid ring pumps of the type described above by permitting operation at lower speeds with reduced risk of instability.

It is still another object of this invention to reduce the rate of pumping liquid consumption in liquid ring pumps of the type described above.

SUMMARY OF THE INVENTION

These and other objects of this invention are accomplished in accordance with the principles of the invention by providing a conically or cylindrically ported liquid ring pump in which, in addition to the intake and discharge ports, the port member has a vent-recirculation port located after the intake port but before the discharge port in the direction of rotor rotation. The head of the pump also defines a sump chamber for normally retaining a quantity of pumping liquid. The sump chamber communicates with the gas outlet of the pump at a location above the normal sump liquid level. The vent-recirculation port is connected to the sump chamber at a location below the normal sump liquid level.

When the pump is operating at relatively low compression ratios (i.e., at compression ratios below the design compression ratio for the final discharge port), the vent-recirculation port acts as a vent or an additional discharge port for allowing gas to reach the pump outlet via the sump chamber. This substantially prevents overcompression of the gas at low compression ratios. At intermediate compression ratios, the vent-recirculation port may be essentially inoperative, being substantially closed off by the pumping liquid in the sump chamber. At higher compression ratios (i.e., at the design compression ratio for the final discharge port or at even higher compression ratios), pumping liquid from the sump chamber is pulled back into the liquid ring via the vent-recirculation port, which then acts as a recirculation path.

Further features of the invention, its nature and various advantages will be more apparent from the accompanying drawing and the following detailed description of the invention.

BRIEF DESCRIPTION OF THE DRAWING

FIG. 15 is a sectional view taken along the line 15—15 in FIG. 3 with part of the end shroud of the rotor cut away.

FIG. 16 is a simplified cross sectional view of a port member like that shown in FIG. 10, but illustrating an alternative embodiment of the invention.

FIG. 17 is a partial view similar to FIG. 16 showing another possible feature of the apparatus in accordance with the invention.

DETAILED DESCRIPTION OF THE INVENTION

Figure 1:
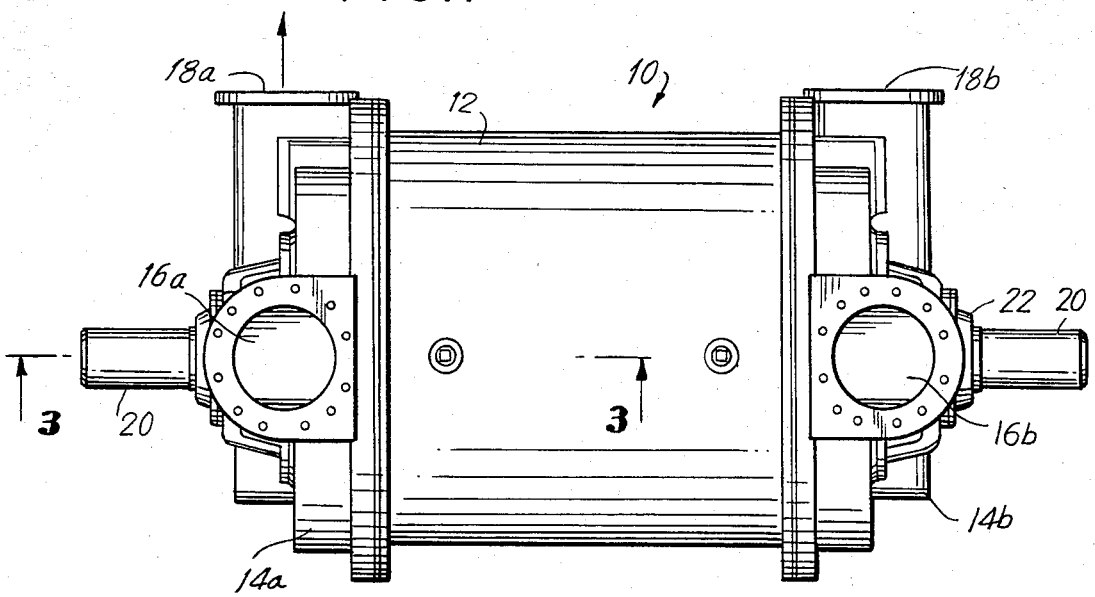
FIG. 1 is a plan view of a double-ended liquid ring pump constructed in accordance with the principles of this invention.
Figure 2:
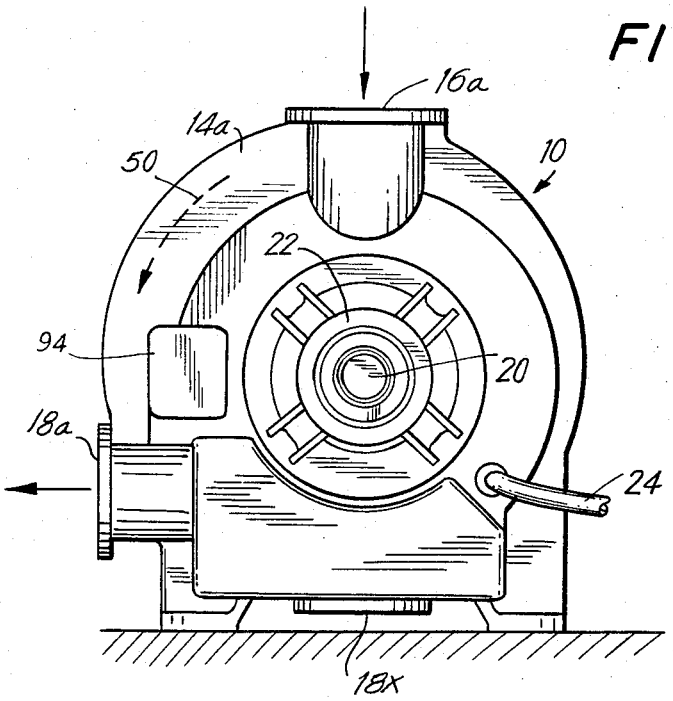
FIG. 2 is an elevational view of the left-hand end of the pump as viewed in FIG. 1.
Figure 3:
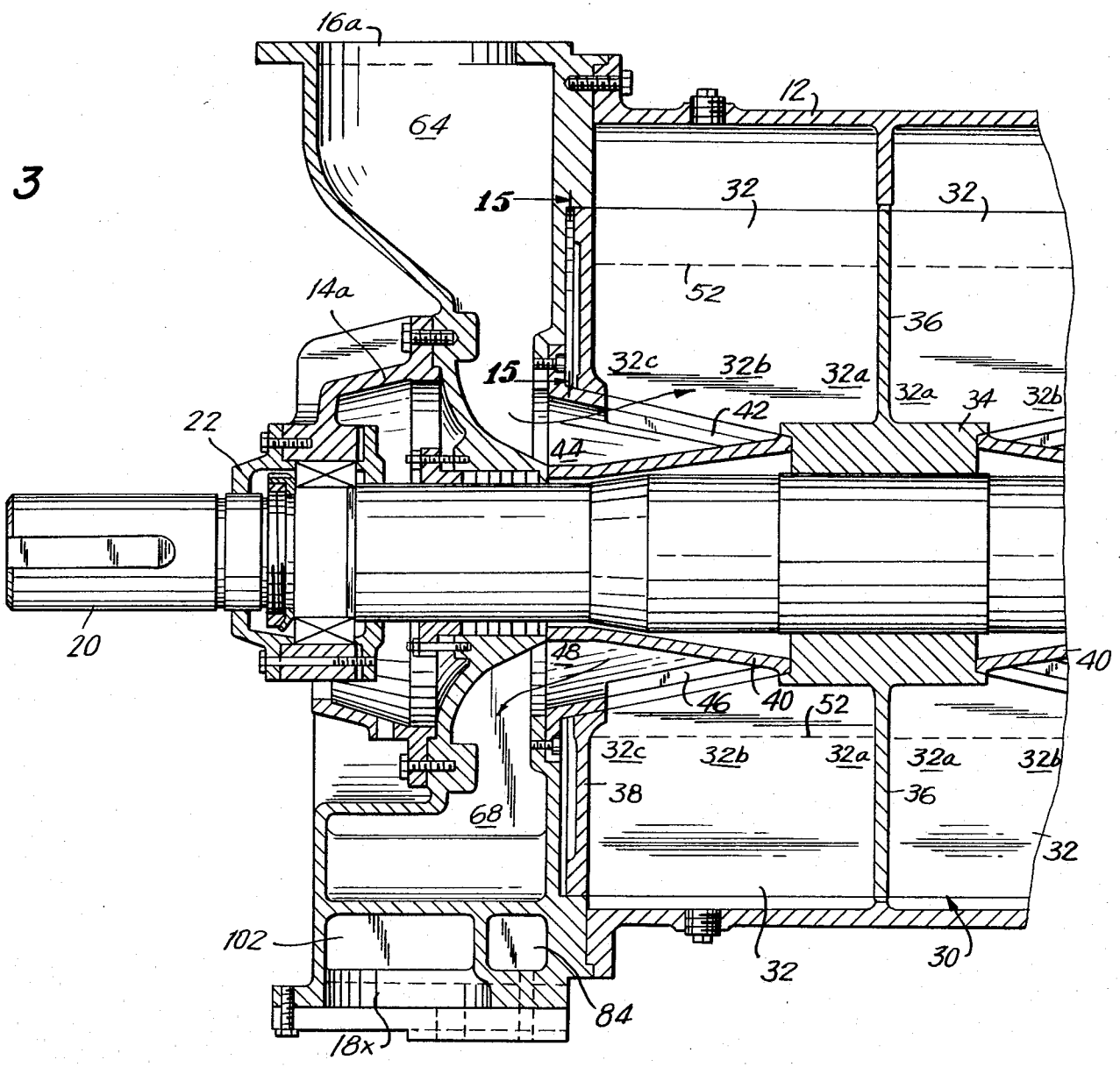
FIG. 3 is a partial sectional view taken along the line 3—3 in FIG. 1.

As shown in FIGS. 1-3, illustrative liquid ring pump 10 includes cylindrical housing 12 having two head members 14*a* and 14*b* at respective opposite ends of housing 12. Because the two ends of the pump are substantially mirror images of one another, only the left-hand end of the pump as viewed in FIG. 1 will be shown and described in full detail herein.

Each head 14*a*, 14*b* has a pump inlet 16*a*, 16*b*, respectively. Each head 14*a*, 14*b* also has a primary pump outlet 18*a*, 18*b*, respectively, and an alternate pump outlet 18*x*, 18*y*, respectively. In general, either outlet can be used in each head to suit the convenience of the user. The outlet which is not being used is covered by a cover plate. Gas to be pumped is supplied to inlets 16 via conduits (not shown). After compression by the pump, the gas exits via outlets 18 and is conveyed away by other conduits (also not shown).

Shaft 20 is eccentrically mounted for rotation in housing 12. In other words, the rotational axis of shaft 20 is parallel to but laterally offset from the central axis of cylindrical housing 12. Shaft 20 passes through each head 14 and is supported for rotation by bearing assemblies 22 fixed to the heads. Shaft 20 is rotated by a suitable pump motor (not shown) in the direction indicated by arrow 50.

Fixedly mounted on shaft 20 inside housing 12 is a rotor 30 having a plurality of blades 32 extending radially outward from hub 34. The cross sectional shape of each blade and the typical circumferential spacing of the blades around the rotor hub are illustrated in FIG. 15. Although hooked slightly near their outer tips, blades 32 may be thought of as substantially planar, the plane of each blade being parallel to the axis of shaft 20.

Blades 32 are substantially longer parallel to shaft 20 than hub 34. Blades 32 are divided in half lengthwise and also stiffened by annular divider 36, which extends radially outward from hub 34 all the way to the outer tips of the blades. Each half of each blade has three lengthwise parts: a first part 32*a* where the blade is connected to hub 34; a second part 32*b* where the blade is radially spaced from shaft 20 and unsupported by any connection to the adjacent blades; and a third part 32*c* where the blade is also radially spaced from shaft 20 but connected to annular end shroud 38. Annular end shroud 38 is a substantially planar toroidal or washer-shaped member which extends from an inner circle immediately adjacent to port member 40 (described below) to an outer circle adjacent the outer tips of blades 32. End shroud 38 stiffens the otherwise unsupported ends of blades 32 and also closes off the ends of the gas pumping chamber formed between adjacent blades. Although only one end of rotor 30 is visible in FIG. 3, it will be understood that there is an end shroud 38 at each end of the rotor.

Because the above-described second and third portions 32*b* and 32*c* of each blade 32 are radially spaced from shaft 20, the result is an annular space around shaft 20 adjacent each end of the rotor. An annular port member 40 is fixedly mounted on each of head members 14 and projects into this annular space at the adjacent end of rotor 30. Thus each of port members 40 is an annular structure surrounding the adjacent portion of shaft 20.

A quantity of pumping liquid such as water is maintained in housing 12. Any pumping liquid which is lost during operation of the apparatus is made up by fresh pumping liquid supplied to the pump via conduit 25 (FIG. 2). When rotor 30 is rotated (in the direction indicated by arrow 50), blades 32 engage the pumping liquid and cause it to form an annular ring substantially concentric with housing 12. Although the liquid ring is typically quite turbulent so that its inner surface is irregular, the approximate location of this inner surface is represented by broken lines 52 in FIG. 3. Because rotor 30 is eccentric to housing 12, rotor blades 32 (which always engage the liquid ring to some degree) extend farther into the liquid ring on one side of the pump than on the other side. This can be seen in FIG. 3 where the rotor blade 32 which is visible near the bottom of the pump projects farther into the liquid ring than the rotor blade 32 which is visible near the top of the pump. Accordingly, the gas pumping chambers on the upper right side of the pump as viewed in FIG. 2 are expanding in the direction of rotor rotation. This portion of the pump is therefore the gas intake zone of the pump. The gas pumping chambers on the lower left side of the pump are contracting in the direction of rotor rotation. This portion of the pump is therefore the gas compression zone of the pump.

As can be seen in FIG. 3, each port member 40 includes an intake port 42 which is located near the inner edges of rotor blade portions 32*b* adjacent the intake zone of the pump. Port member 40 also defines an intake conduit 44 which connects to an intake conduit 64 in the adjacent head member 14. Intake conduit 64 leads to the associated pump inlet 16. Gas supplied to pump inlet 16 is therefore drawn into the intake zone of the pump via conduits 64 and 44 and intake port 42.

As is also visible in FIG. 3, each port member 40 further includes a discharge port 46 which is located near the edges of rotor blade portions 32*b* adjacent the compression zone of the pump. Port member 40 also defines a discharge conduit 48 which connects to a discharge conduit 68 in the adjacent head member 14. Discharge conduit 68 leads to the associated pump outlet 18 (see FIG. 4). Gas compressed by the pump is therefore discharged from the compression zone of the pump via discharge port 46 and discharge conduits 48 and 68.

Figure 10:
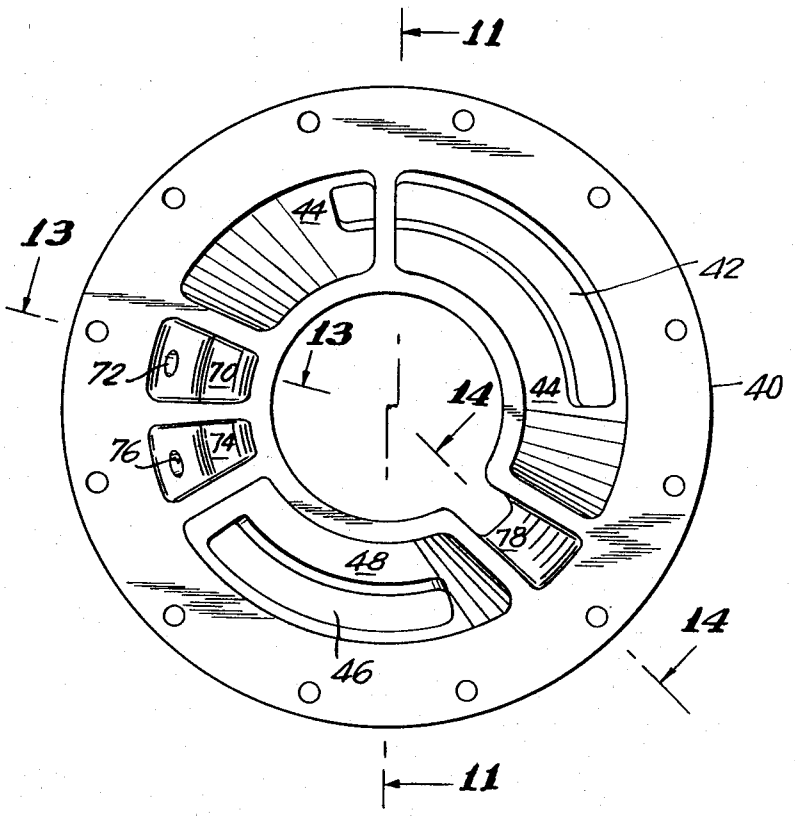
FIG. 10 is an end view of the port member associated with the head member shown in FIG. 4. This view is taken in the same direction as FIG. 4.
Figure 13:
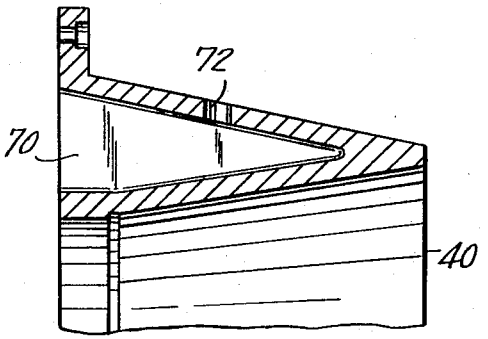
FIGS. 13 and 14 are sectional views taken respectively along the lines 13—13 and 14—14 in FIG. 10.
Figure 14:
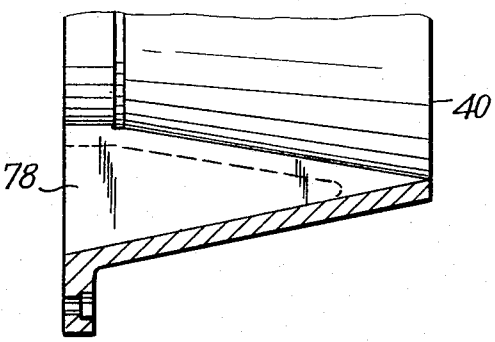
Figure 12:
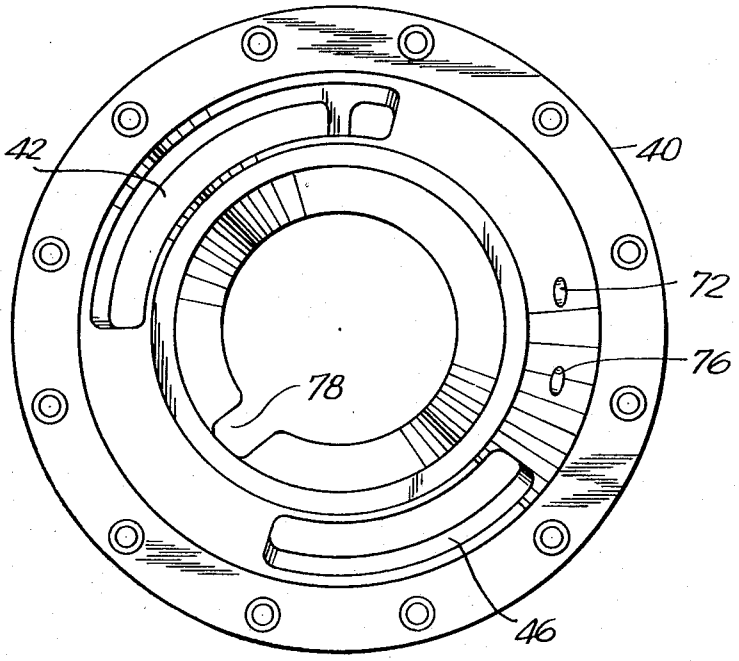
FIG. 12 is an end view of the opposite end of the port member shown in FIG. 10.

The detailed shape of port member 40 is better seen in FIGS. 10–14. FIG. 10 is an end view of left-hand port member 40 as seen from the adjacent head member 14*a*. FIG. 12 is an opposite end view of the same port member. Proceeding counterclockwise around the structure shown in FIG. 10, intake conduit 44 occupies approximately one half of the interior of the port member. Intake port 42 spans a major portion of conduit 44. The next part of port member 40 is vent conduit 70 which communicates with vent port 72 in the conical outer surface of the port member. The operation of vent port 72 will be described in greater detail below, but it should be noted here that vent port 72 is located near the inner edges of rotor blade portions 32*b* adjacent an initial portion of the compression zone of the pump. The next part of port member 40 is vent-recirculation conduit 74 which communicates with vent-recirculation port 76. Vent-recirculation port 76 is located near the inner edges of rotor blade portions 32*b* adjacent an intermediate portion of the compression zone of the pump. The next portion of port member 40 is discharge port 46 and associated discharge conduit 48. The final portion of port member 40 is pumping liquid conduit 78 for conveying pumping liquid from conduit 24 to a point adjacent the rotor hub to replenish the liquid ring and to also provide a gas seal at that point in the pump.

Figure 6:
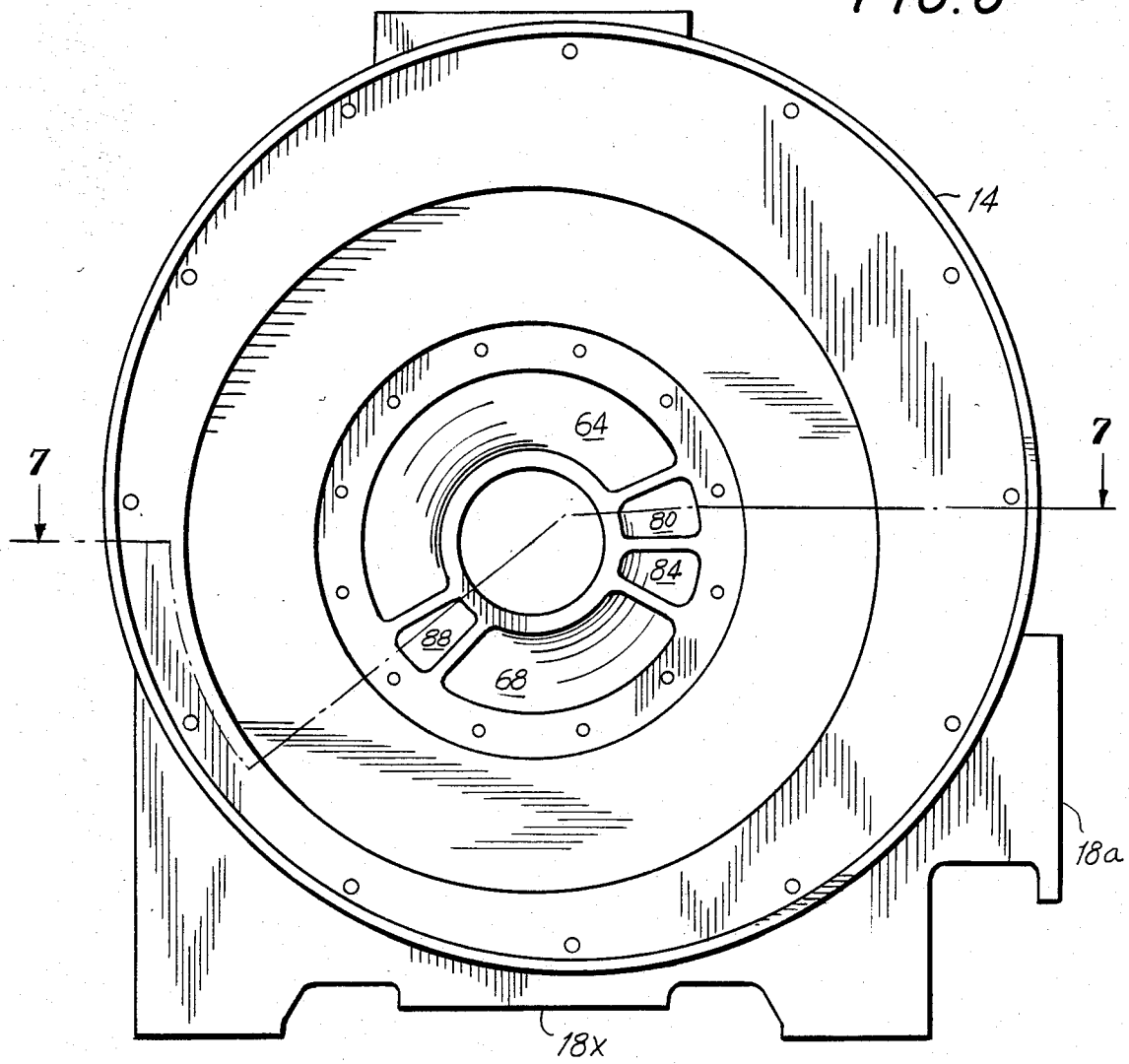
FIG. 6 is an elevational view of the opposite side of the head member shown in FIG. 4.

Each of port member conduits 44, 70, 74, 48, and 78 is completely separate from the other conduits in port member 40. However, each of these port member conduits communicates with a corresponding conduit in the adjacent head member 14. FIG. 6 shows the port member side of the head member 14*a* which is intended for connection to the port member 40 shown in FIGS. 10–14. Proceeding clockwise around the central portion of the structure shown in FIG. 6, intake conduit 64 is designed to communicate with intake conduit 44 in port member 40. Vent conduit 80 is designed to communicate with vent conduit 70 in port member 40. Vent-recirculation conduit 84 is designed to communicate with vent-recirculation conduit 74 in port member 40. Discharge conduit 68 is designed to communicate with discharge conduit 48 in port member 40. And pumping liquid conduit 88 is designed to communicate with pumping liquid conduit 78 in port member 40.

Figure 4:
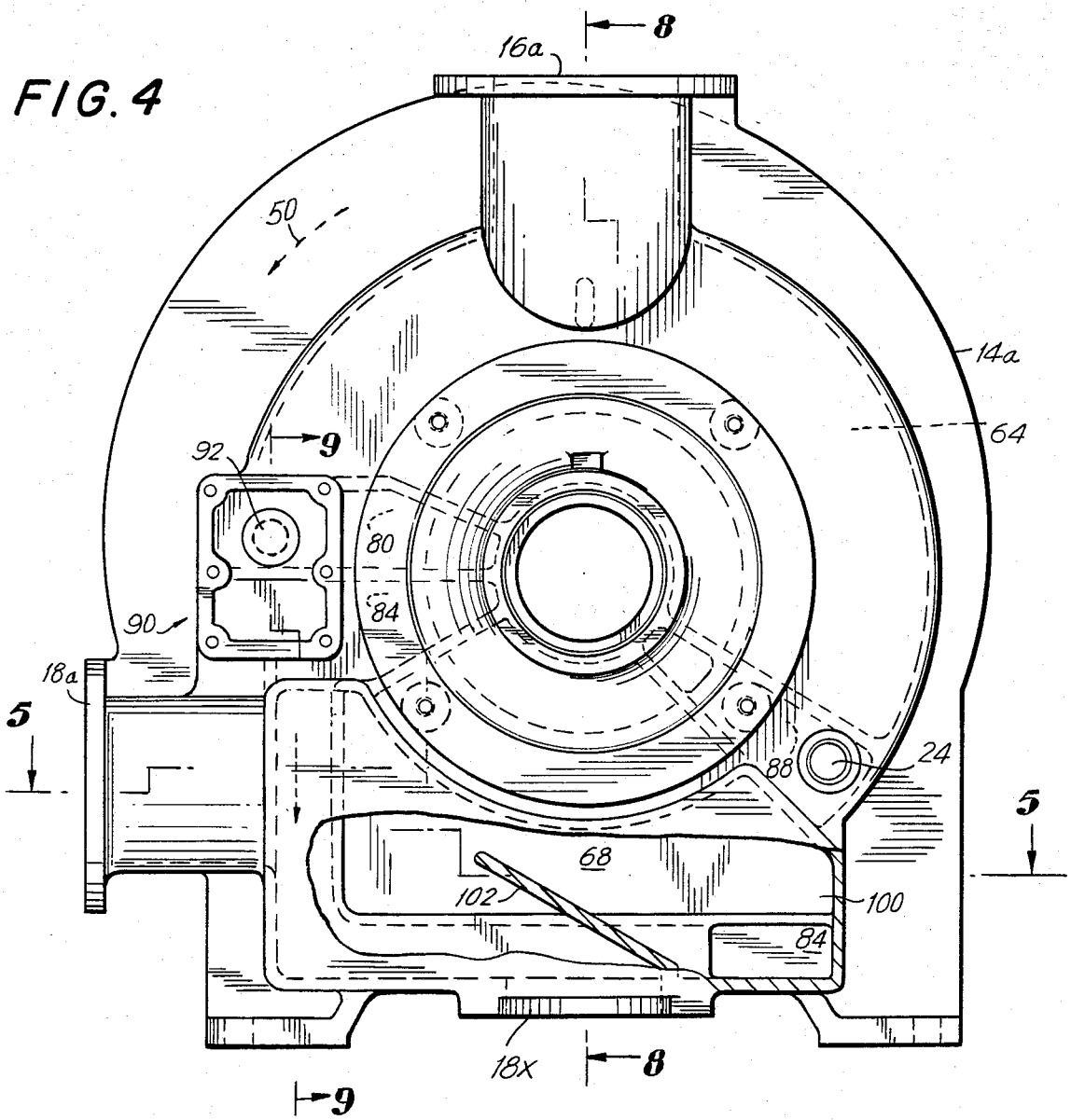
FIG. 4 is an elevational view, partly in section, of the left-hand head member of the pump as viewed in FIG. 1.
Figure 7:
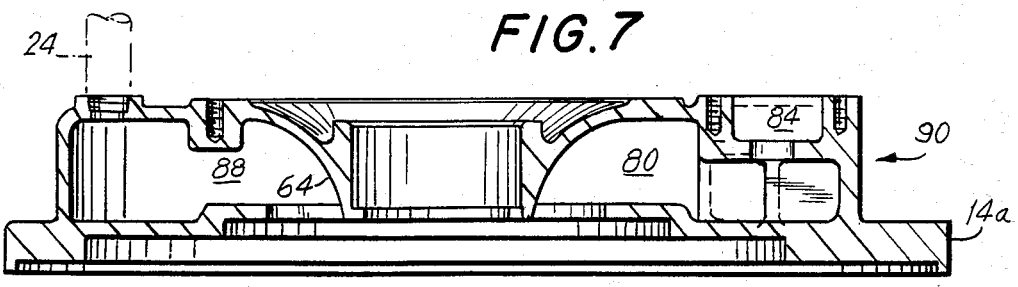
FIG. 7 is a sectional view taken along the line 7—7 in FIG. 6.
Figure 8:
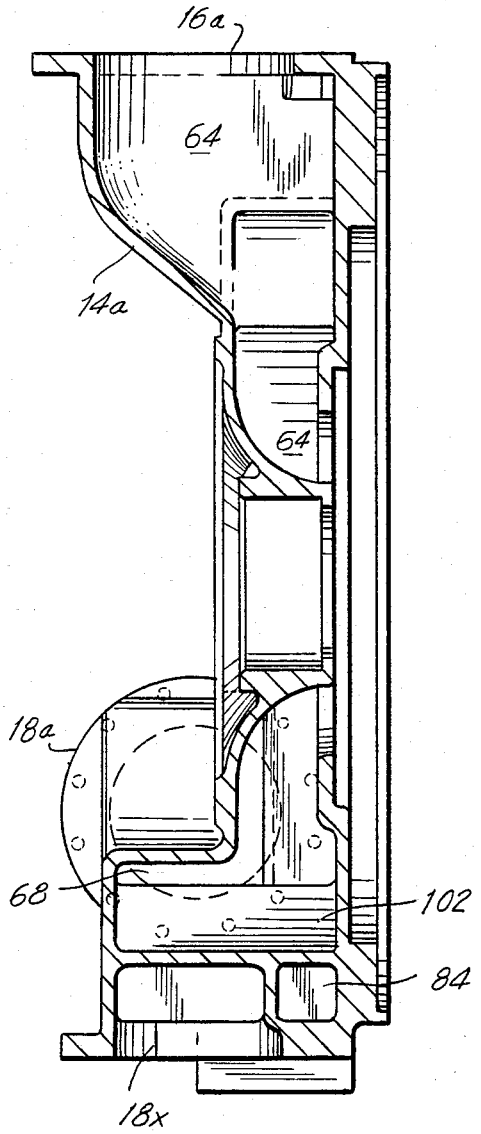
FIG. 8 is a sectional view taken along the line 8—8 in FIG. 4.
Figure 9:
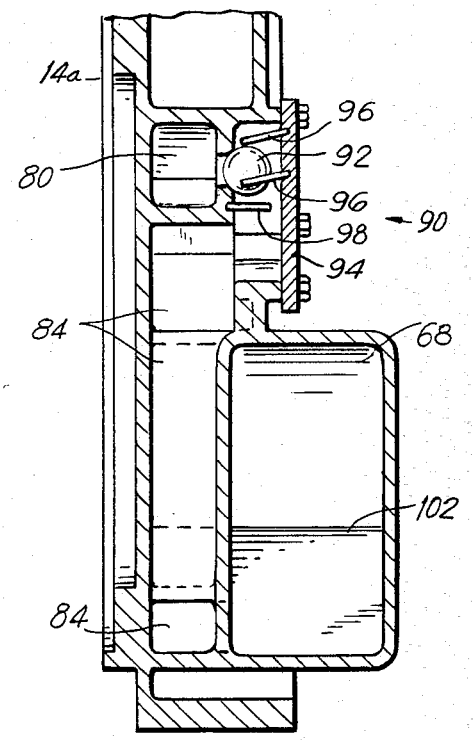
FIG. 9 is a sectional view taken along the line 9—9 in FIG. 4.
Figure 11:
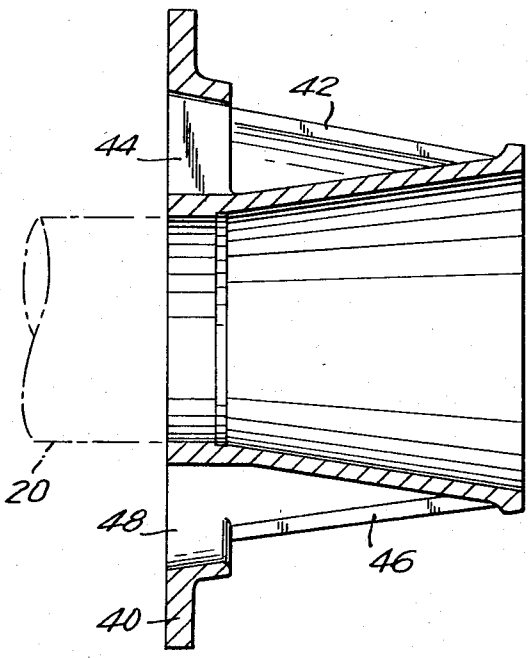
FIG. 11 is a sectional view taken along the line 11—11 in FIG. 10.

Considering now the arrangement of the conduits in head member 14*a*, intake conduit 64 can be seen in broken lines in FIG. 4 to be a relatively large semi-cylindrical chamber which communicates with pump inlet 16*a* at the top of the pump (see also FIGS. 3 and 8). Vent conduit 80 is also visible in broken lines in FIG. 4 as a truncated wedge shaped chamber which leads to check valve assembly 90 (see also FIGS. 7 and 9). Check valve assembly 90 includes ball-type check valve 92 between vent conduit 80 and vent-circulation conduit 84. When the pressure in vent conduit 80 is greater than the pressure in vent-recirculation conduit 84, check valve 92 opens to allow fluid to flow from conduit 80 to conduit 84. When the pressure in vent conduit 80 is not greater than the pressure in vent-recirculation conduit 84, check valve 92 remains closed, thereby effectively closing vent port 72. Check valve assembly 90 has a removable cover plate 94 for facilitating maintenance of check valve 92. The check valve ball is guided by three parallel pins 96 (only two of which are visible in FIG. 9) which are mounted on cover plate 94 and which slope downwardly away from the cover plate toward the wall between conduits 80 and 84. One or more additional horizontal pins 98 are mounted on the wall between conduits 80 and 84 to temporarily support the check valve ball during removal or replacement of cover plate 94.

Figure 5:
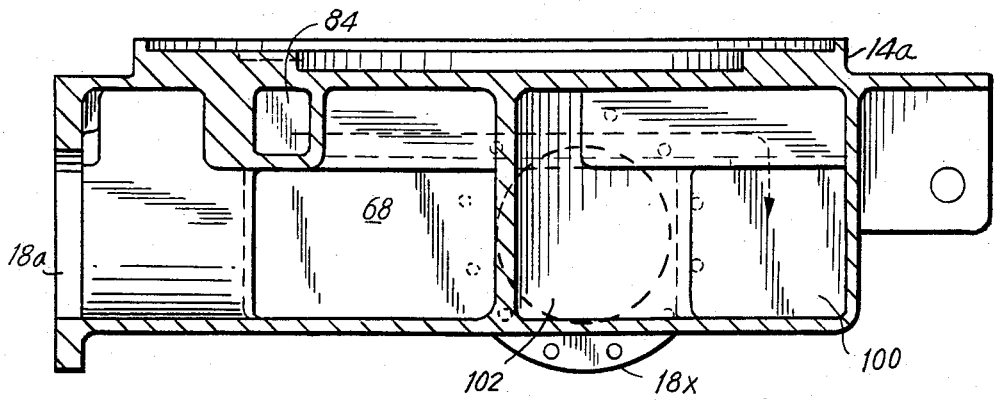
FIG. 5 is a sectional view taken along the line 5—5 in FIG. 4.

Vent-recirculation conduit 84 is also visible in broken lines in FIG. 4. The portion of conduit 84 closest to port member 40 is another truncated wedge shaped chamber which communicates with the lower portion of check valve assembly 90 (see also FIG. 9). Below check valve assembly 90, vent-recirculation conduit 84 runs vertically downward and has an approximately square cross section as can be seen in FIG. 5 (see also FIG. 9). Near the bottom of the pump, vent-recirculation conduit 84 makes a right angle turn and runs horizontally across the pump (see FIGS. 4, 5, and 8). At the right-hand side of the pump as viewed in FIG. 4, vent-recirculation conduit 84 opens out into the bottom of a sump chamber 100 formed in head member 14 to the right of baffle member 102. Sump chamber 100 communicates with discharge conduit 68 and is designed to collect and retain at least some of the pumping liquid which is normally discharged from the liquid ring with the compressed gas. Although conditions in discharge conduit 68 and sump chamber 100 are typically very turbulent so that the boundary between the liquid and gas phases is poorly defined, vent-recirculation conduit 84 communicates with sump chamber 100 at a point which is at least nominally below the normal level of pumping liquid in the sump chamber. It should be noted that baffle member 102 does not pass through vent-recirculation conduit 84.

Discharge conduit 68 is visible in both dotted and solid lines in FIG. 4. The portion of conduit 68 to the right of baffle member 102 as viewed in FIG. 4 communicates with sump chamber 100 as mentioned above. To the left of baffle member 102, conduit 68 communicates with pump outlet 18*a* and alternate pump outlet 18*x*.

Pumping liquid conduit 88 is also visible in broken lines in FIG. 4 and is another truncated wedge shaped chamber which communicates with pumping liquid supply conduit 24.

The operation of the pump under various operating conditions will now be described. At compression ratios below the design compression ratio for the final discharge port, gas enters the pump via pump inlet 16 and flows through conduits 64 and 44 into rotor 30 in the intake zone of the pump. The make-up stream of pumping liquid flows from conduit 24, through conduits 88 and 78, around the small end of conical port member 40, and into the liquid ring via the gas pumping chambers formed between adjacent pairs of rotor blades 32. Because the overall compression ratio is assumed to be low, the gas reaches the final discharge pressure of the pump soon after entering the compression zone of the pump. Accordingly, some of the gas exits from the rotor via vent port 72 and flows through conduits 70 and 80, through check valve 92, and into conduit 84. From conduit 84 this gas flows through sump chamber 100 and discharge conduit 68 to pump outlet 18. Vent port 72 and the associated conduits therefore relieve the early build-up of gas pressure in the compression zone of the pump at low compression ratios.

After the gas remaining in rotor 30 has passed vent port 72, the gas again reaches the final discharge pressure of the pump adjacent vent-recirculation port 76. Accordingly, a further portion of the gas exits from the rotor via vent-recirculation port 76 and flows through conduit 74 to join the above-described flow of gas in conduit 84. Vent-recirculation port 76 and the associated conduits therefore further relieve the early build-up of gas pressure in the compression zone of the pump at low compression ratios.

The final portion of the gas in rotor 30 again reaches the final discharge pressure of the pump adjacent discharge port 46. Accordingly, the final portion of the gas (and some pumping liquid) exits from the rotor via discharge port 46. This fluid flows through conduits 48 and 68 and exits from the pump via pump outlet 18.

At somewhat higher, but still "intermediate", compression ratios, the gas does not reach the final discharge pressure of the pump until after passing vent port 72. Accordingly, the gas pressure in conduit 80 is less than the pressure in conduit 84 and check valve 92 is closed. Vent port 72 is therefore effectively closed. The gas does reach the final discharge pressure of the pump adjacent vent-recirculation port 76. Accordingly, a portion of the gas exits from rotor 30 via vent-recirculation port 76. This gas flows through the conduits 74 and 84, through sump chamber 100, and into conduit 68, which conveys it to pump outlet 18. Vent-recirculation port 76 and the associated conduits therefore act as a vent for relieving early build-up of gas pressure in the pump when operating at intermediate compression ratios.

The gas remaining in rotor 30 after passing vent-recirculation port 76 again reaches the final discharge pressure of the pump adjacent discharge port 46. Accordingly, the remainder of the gas (and some pumping liquid) exits from rotor 30 via discharge port 46. This fluid flows to pump outlet 18 via conduits 48 and 68.

At the highest compression ratios attainable by the pump, the gas in rotor 30 does not reach the final discharge pressure of the pump until after passing both vent port 72 and vent-recirculation port 76. Thus check valve 92 is again held closed by the fact that the pressure in conduits 70 and 80 is lower than the pressure in conduit 84.

If the gas pressure in rotor 30 adjacent vent-recirculation port 76 is nearly equal to the final discharge pressure, there will be little or no fluid flow in either direction in conduits 74 and 84. Under these conditions fluid flow in these conduits tends to be reduced or suppressed by the presence of a high pecentage of pumping liquid in these conduits and sump chamber 100. On the other hand, if the gas pressure in rotor 30 adjacent vent-recirculation port 76 is substantially less than the final discharge pressure, a mixture of gas and pumping liquid will flow from discharge conduit 68 and sump chamber 100 back into rotor 30 via conduits 84 and 74 and vent-recirculation port 76. Although the recirculation flow thus induced in the pump typically includes some gas, it also typically includes a significant percentage of pumping liquid because of the connection of conduit 84 to the bottom of sump chamber 100. Accordingly, vent-recirculation port 76 and the associated conduits operate to automatically increase the volume of the liquid ring when the pump reaches high compression ratios. This extends the operating range of the pump to compression ratios substantially higher than could otherwise be attained. Recirculation of pumping liquid in the pump helps reduce the necessity for a high flow of make-up pumping liquid. The fact that the volume of gas in the recirculated fluid flow is reduced by the substantial fraction of pumping liquid in that flow greatly reduces the inefficiency associated with recirculating gas in a liquid ring pump.

From the foregoing, it will be seen that this invention greatly extends the range of compression ratios over which a conically or cylindrically ported liquid ring pump can be made to operate efficiently. At low and intermediate compression ratios, vent port 72 and/or vent-recirculation port 76 prevent wasteful overcompression of the gas in the rotor of the pump, thereby reducing the power required to operate the pump at these compression ratios. And at higher compression ratios, vent port 72 is closed and vent-recirculation port 76 is also either effectively closed or recirculating fluid including a high proportion of pumping liquid, thereby extending the operating range of the pump to compression ratios substantially higher than could otherwise be attained.

The present invention also enables conically or cylindrically ported liquid ring pumps to better respond to operating condition fluctuations. For example, if the flow of gas to the pump suddenly increases, or if a large slug of liquid suddenly enters the pump via pump inlet 16, vent port 72 and/or vent-recirculation port 76 instantly and automatically begin to vent rotor 30 to prevent overcompression in the pump.

If desired, vent port 72 and associated conduits 70 and 80 and check valve assembly 90 can be eliminated as shown in FIG. 16. In all other respects the pump of FIG. 16 can be the same as shown and described above, except that it will not have the early venting provided by vent port 72 and the associated elements.

Vent-recirculation port 76 can be provided with a nozzle shape as shown in FIG. 17. This nozzle shape is smoothly convergent in the favorable or inward flow direction and is square-edged in the unfavorable or outward flow direction. This shape promotes inward flow (i.e., venting), and somewhat inhibits outward flow (i.e., recirculation). This may be desirable so that port 76, which is of fixed size, provides a larger volume of venting flow than recirculation flow.

Figure 18:
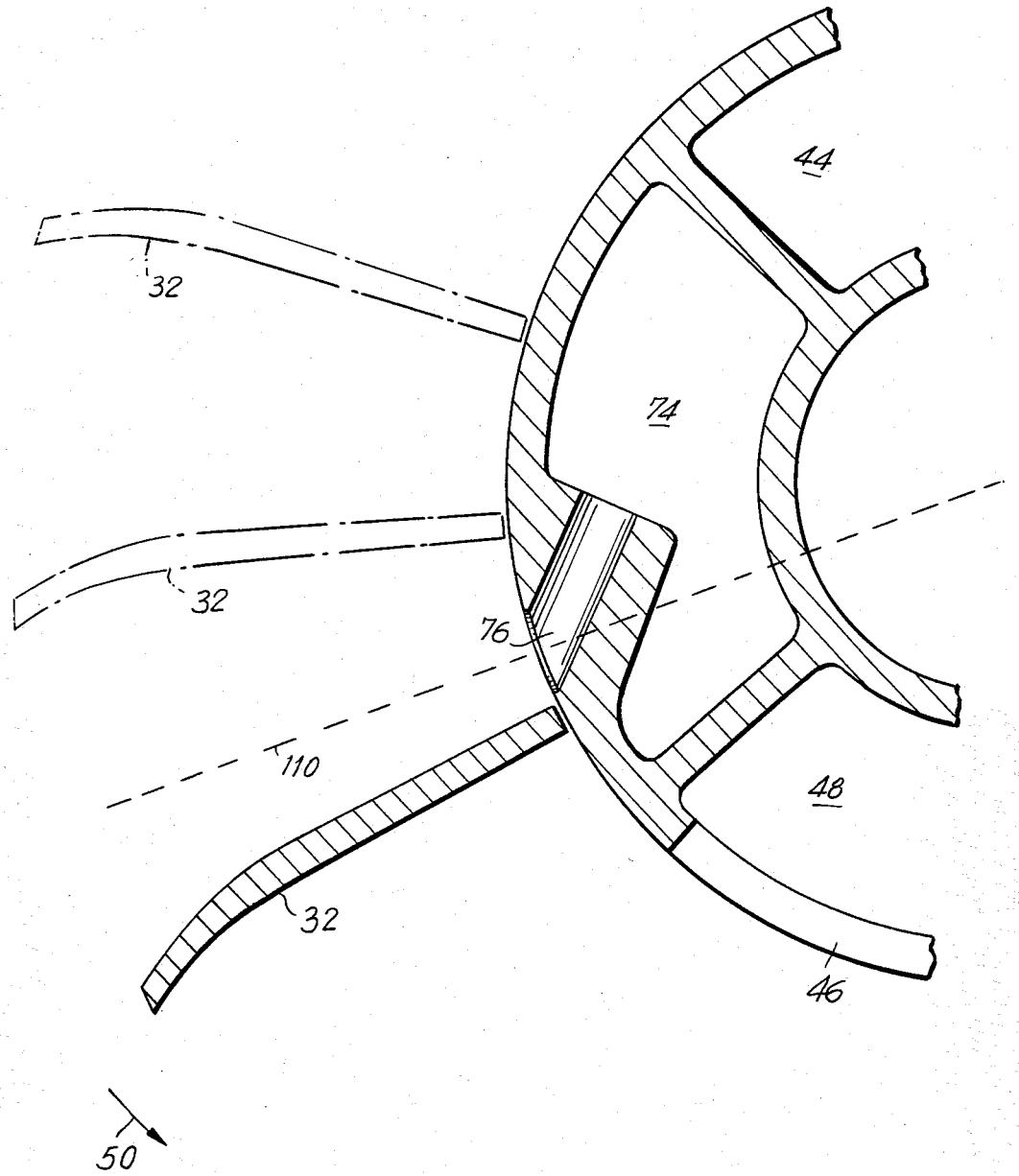
FIG. 18 is a view similar to FIG. 17 showing yet another possible feature of the apparatus in accordance with the invention.

Vent-recirculation port 76 can be angled relative to the adjacent radial axis 110 of the pump as shown in FIG. 18. In particular, vent-recirculation port 76 is inclined in the direction of rotor rotation from conduit 74 toward the adjacent portion of rotor 30. This gives the recirculated fluid re-entering rotor 30 via port 76 a component of velocity parallel to the direction of motion of the adjacent rotor blades 32. This in turn reduces energy losses in the pump due to reorienting the flow of recirculated fluid so that it is parallel to the direction of motion of the adjacent rotor blades.

It will be understood that the embodiments shown and described above are merely illustrative of the principles of this invention, and that various modifications can be implemented by those skilled in the art without departing from the scope and spirit of the invention. For example, although the pump shown and described above is double-ended, it will be understood that a single-ended pump could be constructed by eliminating one of the two halves of the double-ended pump. Also, although the pump shown and described above has conical port members, those skilled in the art will appreciate that the pump could alternatively be constructed with cylindrical port members as described in detail above.

We claim:

1. A liquid ring pump comprising:

a longitudinal annular housing;

a rotatable shaft having a longitudinal axis parallel to the longitudinal axis of the housing, the shaft being eccentrically mounted in the housing;

a rotor fixedly mounted on the shaft and including (1) a plurality of blades extending radially outward from the shaft in planes substantially parallel to the longitudinal axis of the shaft, each blade having first, second, and third portions which are spaced from one another along the length of the shaft, each blade being connected to the shaft adjacent the first portion and being radially spaced from the shaft adjacent the second and third portions, and (2) a planar toroidal shroud member disposed around and radially spaced from the shaft, the toroidal shroud member connecting the third portions of all of the blades, the surface of the second portion of each blade which is radially opposite and faces toward the shaft being defined as the inner surface of the blade;

an annular port member disposed around the shaft and extending into the annular space between the shaft and the second and third portions of the blades, the port member having an annular port surface which is immediately adjacent the inner surfaces of the blades and which faces radially away from the shaft, the port surface having first, second, and third orifices adjacent the second portions of the blades, the first orifice being an intake port for admitting gas to the rotor in an intake zone of the pump, the second orifice being a discharge port for receiving gas discharged from the rotor in a compression zone of the pump, and the third orifice being a vent-recirculation port located after the intake port but before the discharge port in the direction of rotor rotation; and a head member connected to the port member remote from the rotor and defining (1) a pump intake conduit for admitting gas to be pumped, (2) a pump discharge conduit for discharging gas pumped by the pump, and (3) a sump chamber for normally retaining a quantity of pumping liquid in the head member, the intake and discharge conduits and the sump chamber being axially spaced from the shroud member on the side of the shroud member remote from the blades;

the port member and the head member further jointly defining (1) a first conduit connecting the pump intake conduit and the intake port, (2) a second conduit connecting the discharge port and the pump discharge conduit, the second conduit communicating with the sump chamber above the normal level of pumping liquid in the sump chamber and (3) a third conduit connecting the vent-recirculation port and a location in the sump chamber below the normal level of pumping liquid in the sump chamber, all of the first, second, and third conduits separately passing through the annular space between the shaft and the shroud member.

2. The apparatus defined in claim 1 wherein the port surface further includes a fourth orifice adjacent the second portions of the blades, the fourth orifice being a vent port located after the intake port but before the vent-recirculation port in the direction of rotor rotation, and wherein the port member and the head member further jointly define a fourth conduit connecting the vent port and a portion of the third conduit which is axially spaced from the shroud member on the side of the shroud member remote from the blades, the fourth conduit passing separately through the annular space between the shaft and the shroud member.

3. The apparatus defined in claim 2 further comprising a check valve in a portion of the fourth conduit which is axially spaced from the shroud member on the side of the shroud member remote from the blades for permitting fluid flow only from the vent port to the third conduit.

4. The apparatus defined in claim 1 wherein the portion of the third conduit immediately adjacent the vent-recirculation port has a nozzle shape for promoting flow into the port member from the rotor and for restricting flow in the opposite direction.

5. The apparatus defined in claim 1 wherein the portion of the third conduit immediately adjacent the vent-recirculation port is angled in the direction of motion of the adjacent portion of the rotor.

* * * * *